US009151476B2

(12) United States Patent
Toyohisa et al.

(10) Patent No.: US 9,151,476 B2
(45) Date of Patent: Oct. 6, 2015

(54) LIGHTING APPARATUS

(75) Inventors: Shozo Toyohisa, Kawasaki (JP); Chie Kanazawa, Higashiomi (JP); Tsuneyuki Hirabayashi, Koka (JP); Shingo Matsuura, Omihachiman (JP)

(73) Assignee: Kyocera Corporation, Kyoto (JP)

( * ) Notice: Subject to any disclaimer, the term of this patent is extended or adjusted under 35 U.S.C. 154(b) by 12 days.

(21) Appl. No.: 14/117,684

(22) PCT Filed: May 28, 2012

(86) PCT No.: PCT/JP2012/063642

§ 371 (c)(1),
(2), (4) Date: Nov. 14, 2013

(87) PCT Pub. No.: WO2012/165379

PCT Pub. Date: Dec. 6, 2012

(65) Prior Publication Data

US 2014/0085880 A1 Mar. 27, 2014

(30) Foreign Application Priority Data

May 27, 2011 (JP) ..... 2011-119548

(51) Int. Cl.

| | |
|---|---|
| ***F21V 21/02*** | (2006.01) |
| ***F21S 8/04*** | (2006.01) |
| ***F21S 8/00*** | (2006.01) |
| ***F21V 29/70*** | (2015.01) |
| *F21Y 101/02* | (2006.01) |
| *F21Y 103/00* | (2006.01) |
| *F21K 99/00* | (2010.01) |
| *F21V 7/00* | (2006.01) |
| *F21V 21/30* | (2006.01) |
| *F21V 29/507* | (2015.01) |

(52) U.S. Cl.

CPC ..... *F21V 21/02* (2013.01); *F21S 8/033* (2013.01); *F21S 8/04* (2013.01); *F21V 29/70* (2015.01); *F21K 9/30* (2013.01); *F21V 7/005* (2013.01); *F21V 21/30* (2013.01); *F21V 29/507* (2015.01); *F21Y 2101/02* (2013.01); *F21Y 2103/003* (2013.01)

(58) Field of Classification Search

CPC ..... F21S 8/04; F21S 8/033; F21S 4/008; F21V 21/02; F21V 29/70; F21V 7/005; F21V 29/507; F21Y 2101/02; F21Y 2103/003; F21K 9/30

See application file for complete search history.

(56) References Cited

U.S. PATENT DOCUMENTS

| | | | | |
|---|---|---|---|---|
| 2009/0109670 | A1 | 4/2009 | Boyer | |
| 2009/0244893 | A1 | 10/2009 | Villard | |
| 2011/0170285 | A1* | 7/2011 | Mai | 362/218 |

FOREIGN PATENT DOCUMENTS

| | | | |
|---|---|---|---|
| JP | 2009283449 | A | 12/2009 |
| JP | 3164985 | U | 12/2010 |
| JP | 2011501386 | A | 1/2011 |
| KR | 10-2008-0045832 | A | 5/2008 |

OTHER PUBLICATIONS

International Search Report, PCT/JP2012/063642, Jun. 13, 2012, 4 pp.

Korean Office Action with English concise explanation, Korean Patent Application No. 10-2013-7028722, Jan. 21, 2015, 5 pgs.

* cited by examiner

*Primary Examiner* — Thomas M Sember

(74) *Attorney, Agent, or Firm* — Volpe and Koenig, P.C.

(57) ABSTRACT

According to an aspect, a lighting apparatus includes a lighting unit including a long-shaped housing that has upper and lower openings and has an outer surface formed as a convex surface when seen in a cross-section perpendicular to a longitudinal direction, and a semiconductor light emitting device disposed inside the housing so as to emit light toward the lower opening. Further, the lighting apparatus includes a holding unit including a holding member in which at least a portion of a surface is formed as a concave surface corresponding to the convex surface when seen in a cross-section perpendicular to the longitudinal direction of the lighting unit. When seen in the cross-section, the convex surface has, in a region that faces the concave surface, a portion that is brought into contact with the concave surface, and a portion that is not brought into contact with the concave surface.

5 Claims, 14 Drawing Sheets

LIGHTING APPARATUS

CROSS-REFERENCE TO RELATED APPLICATIONS

This application is a National Stage of PCT international application Ser. No. PCT/JP2012/063642 filed on May 28, 2012 which designates the United States, incorporated herein by reference, and which is based upon and claims the benefit of priority from Japanese Patent Application No. 2011-119548, filed on May 27, 2011, the entire contents of which are incorporated herein by reference.

FIELD OF INVENTION

The present invention relates to a lighting apparatus that includes a semiconductor light emitting device.

BACKGROUND

In recent years, development of semiconductor light emitting devices and lighting apparatuses that use a semiconductor light emitting element such as a light emitting diode (LED) as a light source has progressed (for example, see JP 2009-283449 A). The semiconductor light emitting device having a semiconductor light emitting element is gathering attention due to its power consumption or product lifespan.

Incidentally, the semiconductor light emitting device including a semiconductor light emitting element generates heat during driving (that is, when the device outputs light). When the heat generated by the semiconductor light emitting element is transmitted to various parts of the lighting apparatus, the heat may have adverse effect on the various parts. An object of the present invention is to provide a lighting apparatus capable of suppressing adverse effect resulting from heat generated by the semiconductor light emitting element.

SUMMARY

According to an aspect, a lighting apparatus includes a lighting unit including a long-shaped housing that has upper and lower openings and has an outer surface formed as a convex surface when seen in a cross-section perpendicular to a longitudinal direction, and a semiconductor light emitting device disposed inside the housing so as to emit light toward the lower opening. Further, the lighting apparatus includes a holding unit including a holding member in which at least a portion of a surface is formed as a concave surface corresponding to the convex surface when seen in a cross-section perpendicular to the longitudinal direction of the lighting unit. Furthermore, the lighting apparatus includes a connecting member for connecting the lighting unit to the holding member in the upper opening that faces the concave surface. When seen in the cross-section, the convex surface has, in a region that faces the concave surface, a portion that is brought into contact with the concave surface, and a portion that is not brought into contact with the concave surface.

DETAILED DESCRIPTION OF THE PREFERRED EMBODIMENTS

Figure 1:
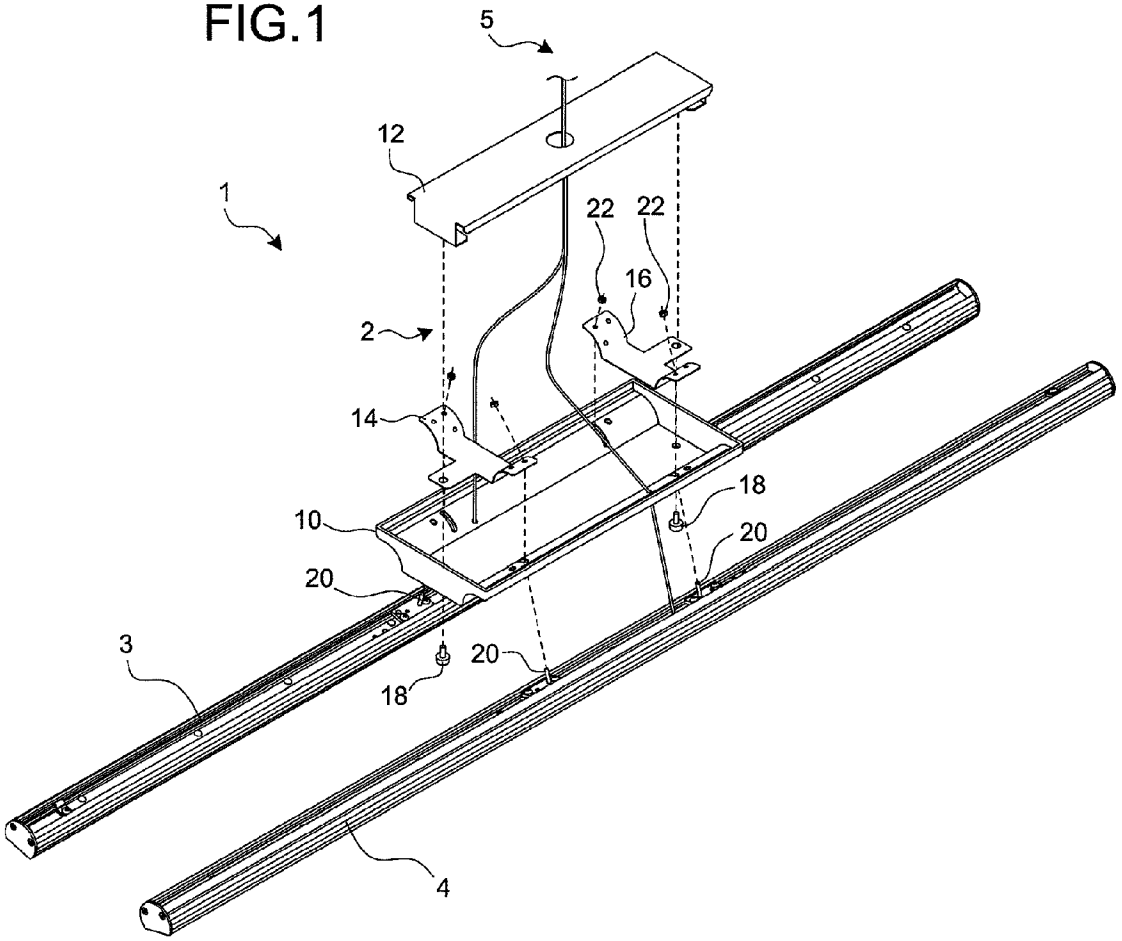
FIG. 1 is an exploded perspective view illustrating an overall configuration of a lighting apparatus according to an embodiment.
Figure 2:
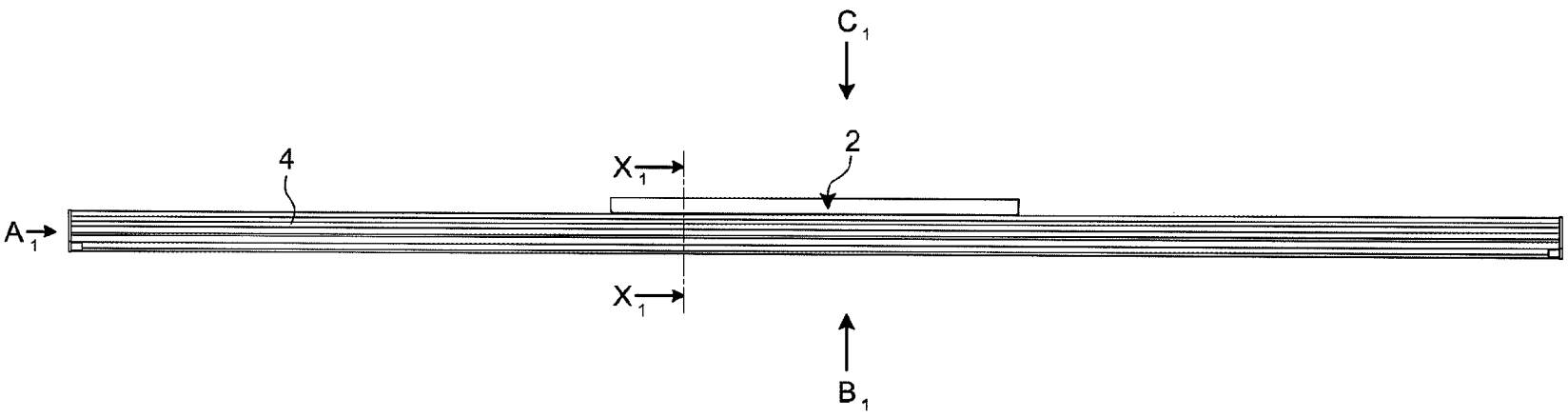
FIG. 2 is an explanatory view of the lighting apparatus illustrated in FIG. 1 when seen from one direction.

Hereinafter, embodiments of a lighting apparatus according to the present invention will be described with reference to the accompanying drawings.

The present invention is not limited to the following embodiments.

<Configuration of Lighting Apparatus>

A lighting apparatus 1 is used in such a manner that it is directly attached to the inside of a room, such as a ceiling or a wall, or at the outside. Thus, light emitted from the lighting apparatus 1 can illuminate the inside or the outside of a room.

The lighting apparatus 1 includes a holding unit 2, a first lighting unit 3 held by the holding unit 2, a second lighting unit 4 held by the holding unit 2, and wires 5 connected to the first and second lighting units 3 and 4. The wires 5 are power lines that supply power to the first and second lighting units 3 and 4. The first and second lighting units 3 and 4 of the present embodiment have a rod shape that extends in one direction. The wires 5 are disposed inside the holding unit 2. The wires 5 are connected to the first and second lighting units 3 and 4 at one ends, and the wires 5 are connected to an external power supply at the other ends. The lighting apparatus 1 has a portion of the wires 5 embedded in the holding unit 2 so that the wires 5 are not easily visible from the outside.

<Configuration of Holding Unit>

The holding unit 2 is a mechanism that holds the first and second lighting units 3 and 4. The holding unit 2 is fixed to an object such as a ceiling or a base, to which the lighting apparatus 1 is fixed. The holding unit 2 includes a first holding member 10, a second holding member 12, and reinforcing members 14 and 16. Moreover, the holding unit 2 includes bolts 18 and 20 and a nut 22 as fastening elements for fastening various parts.

Figure 3:
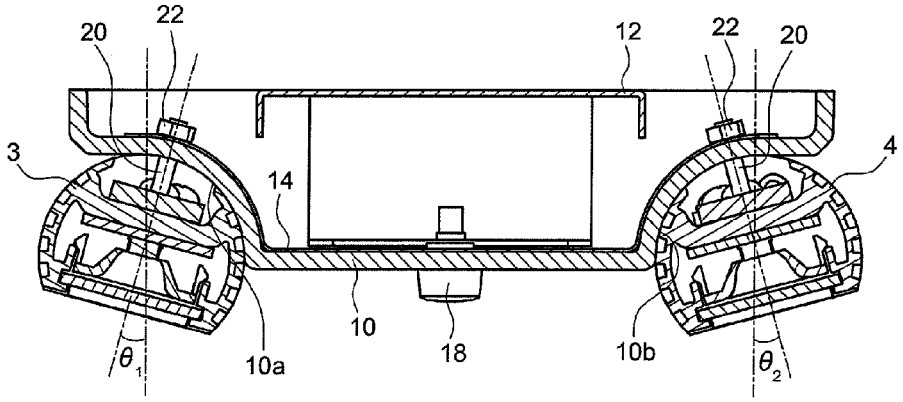
FIG. 3 is a cross-sectional view along line X1-X1, of the lighting apparatus illustrated in FIG. 2.
Figure 4:
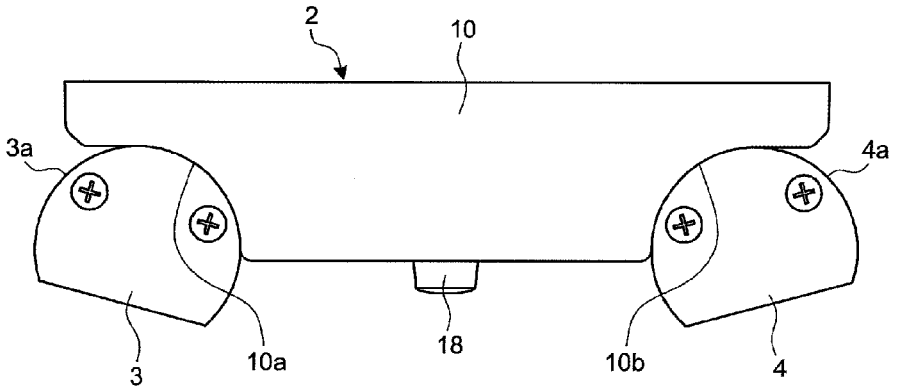
FIG. 4 is an explanatory view of the lighting apparatus illustrated in FIG. 2 when seen from a direction indicated by A1.

The first holding member 10 faces the first and second lighting units 3 and 4 and has a box shape that a surface opposite to a surface that faces the first and second lighting units 3 and 4 is open. The regions of the first holding member 10 facing the first and second lighting units 3 and 4 have a shape that follows the first and second lighting units 3 and 4. The first and second lighting units 3 and 4 of the present embodiment have a long and narrow rod shape. The first and second lighting units 3 and 4 have convex surfaces 3*a* and 4*a* at portions facing the first holding member 10, respectively. The convex surfaces 3*a* and 4*a* have a shape that is convex toward the outside of an outer surface in a cross-section perpendicular to a longitudinal direction. Moreover, the convex surfaces 3*a* and 4*a* have an arc-shaped cross-section that is perpendicular to the longitudinal direction. Thus, as illustrated in FIGS. 3 and 4, the first holding member 10 has concave surfaces 10*a* and 10*b* at regions facing the first and second lighting units 3 and 4, respectively. The concave surface 10*a* is formed at a position where the first lighting unit 3 is connected. The concave surface 10*a* has a shape that is concave (recessed toward the inner side of the first holding member 10) toward a side away from the first lighting unit 3 in the cross-section perpendicular to the longitudinal direction. The concave surface 10*b* is formed at a position where the second lighting unit 4 is connected. The concave surface 10*b* has a shape that is concave (recessed toward the inner side of the first holding member 10) toward a side away from the second lighting unit 4 in the cross-section perpendicular to the longitudinal direction. Moreover, the concave surfaces 10*a* and 10*b* have an arc-shaped cross-section that is perpendicular to the longitudinal direction. That is, the concave surfaces 10*a* and 10*b* have a shape that an arc extends in one direction (longitudinal direction).

Figure 5:
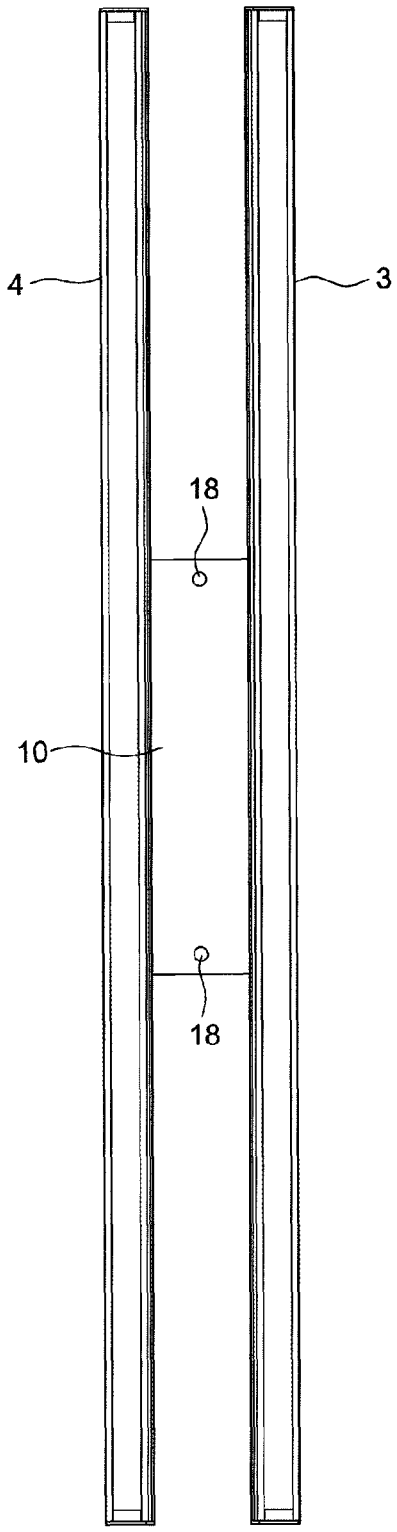
FIG. 5 is an explanatory view of the lighting apparatus illustrated in FIG. 2 when seen from a direction indicated by B1.
Figure 6:
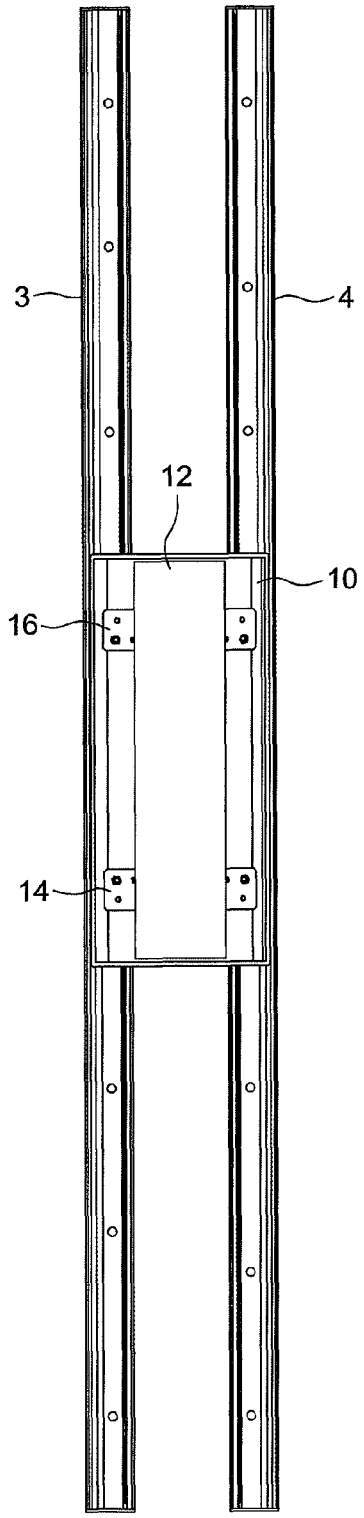
FIG. 6 is an explanatory view of the lighting apparatus illustrated in FIG. 2 when seen from a direction indicated by C1.

The convex surfaces 3*a* and 4*a* of the first and second lighting units 3 and 4 are parts of housings. Moreover, the convex surfaces 3*a* and 4*a* only have to face the concave surfaces 10*a* and 10*b* at least at portions thereof, respectively, in the cross-section perpendicular to the longitudinal direction, and the convex surfaces 3*a* and 4*a* therefore may have a shape that extends to a region other than the region facing the concave surfaces 10*a* and 10*b*. Similarly, the concave surfaces 10*a* and 10*b* only have to face the convex surfaces 3*a* and 4*a* at least portions thereof, respectively, in the cross-section perpendicular to the longitudinal direction, and the concave surfaces 10*a* and 10*b* therefore may have a shape that extends in a region other than the region facing the convex surfaces 3*a* and 4*a*. As illustrated in FIGS. 5 and 6, the length of the first holding member 10 in the extension direction of the first and second lighting units 3 and 4 is smaller than those of the first and second lighting units 3 and 4. Thus, the first holding member 10 faces portions of the first and second lighting units 3 and 4 in the extension direction.

The first holding member 10 is connected to the first lighting unit 3 by the bolt 20 and the nut 22 in a state where a portion of the concave surface 10*a* faces a portion of the convex surface 3*a* of the first lighting unit 3 and a portion of the concave surface 10*a* is brought into contact with a portion of the convex surface 3*a*. Moreover, the first holding member 10 is connected to the second lighting unit 4 by the bolt 20 and the nut 22 in a state where a portion of the concave surface 10*b* faces a portion of the convex surface 4*a* of the second lighting unit 4 and a portion of the concave surface 10*b* is brought into contact with a portion of the convex surface 4*a*.

As illustrated in FIG. 3, the first lighting unit 3 is fixed to the first holding member 10 so that the angle between the axis of the bolt 20 and an axis perpendicular to an attachment surface (a surface to be brought into contact with a base or the like) of the holding unit 2 is $\theta_1$. The second lighting unit 4 is fixed to the first holding member 10 so that the angle between the axis of the bolt 20 and an axis perpendicular to an attachment surface (a surface to be brought into contact with a base or the like) of the holding unit 2 is $\theta_2$. The axis perpendicular to the attachment surface (a surface to be brought into contact with a base or the like) of the holding unit 2 is an axis perpendicular to the attachment surface (a surface to be brought into contact with a base or the like) of the holding unit 2, on a plane perpendicular to the extension direction (the longitudinal direction of the first and second lighting units 3 and 4) of the lighting apparatus 1. Moreover, the axis of the bolt 20 is the axis of the bolt 20 on a plane perpendicular to the extension direction of the lighting apparatus 1. For example, when the lighting apparatus 1 is attached to a horizontal surface such as a ceiling, the axis perpendicular to the attachment surface of the holding unit 2 is an axis that is parallel to the vertical direction. In this case, the lighting apparatus 1 is configured such that the holding unit 2 is brought into contact with the upper surfaces of the first and second lighting units 3 and 4 in the vertical direction. At least a portion of the surfaces of the first and second lighting units 3 and 4 from which light is emitted faces downward in the vertical direction. Accordingly, the axes of the bolts 20 of the first and second lighting units 3 and 4 cross each other on the attachment surface side, that is, the surfaces described later (surfaces opposite to the surfaces to which the bolts 20 are exposed) from which light is output face the outer side.

The first holding member 10 faces parts of the first and second lighting units 3 and 4 and is connected to the first and second lighting units 3 and 4 by the bolt 20 and the nut 22 to thereby hold the first and second lighting units 3 and 4. That is, the bolt 20 and the nut 22 are a connecting member that connects the first holding member 10 and the first lighting unit 3 or the first holding member 10 and the second lighting unit 4. The bolt 20 is fixed to the first lighting unit 3 or the second lighting unit 4. The nut 22 is disposed inside the box shape of the first holding member 10. An opening through which the wires 5 pass is formed in each of the regions of the first holding member 10 facing the first and second lighting units 3 and 4.

The second holding member 12 is a member that is connected to a portion of an object, such as a ceiling and a base, to which the lighting apparatus 1 is installed. The second holding member 12 is a plate-shaped member of which the front surface faces the surface of the first holding member 10 making contact with the first and second lighting units 3 and 4. A projection that protrudes toward the first and second lighting units 3 and 4 is formed on the second holding member 12. The projection of the second holding member 12 is fastened to the first holding member 10 by the bolt 18. When the projection of the second holding member 12 is fastened to the first holding member 10, at least a portion of the plate-shaped member can be exposed to an opening surface of the first holding member 10 while forming a space between the first and second holding members 10 and 12. Moreover, an opening through which the wires 5 pass is formed in the second holding member 12.

The reinforcing members 14 and 16 are plate-shaped members disposed on a surface of the first holding member 10 closer to the second holding member 12. The reinforcing members 14 and 16 have a shape that follows the inside of the box shape of the first holding member 10. The reinforcing members 14 and 16 extend from a connecting portion between the first holding member 10 and the first lighting unit 3 to a connecting portion between the first holding member 10 and the second lighting unit 4. The reinforcing members 14 and 16 are interposed between the bolt 20 and the nut 22 and are fastened together with the first holding member 10 and the first lighting unit 3 or the first holding member 10 and the second lighting unit 4. A bolt hole is formed at the same position of the reinforcing members 14 and 16 as the position where the bolt hole is formed in the first holding member 10. Moreover, the reinforcing members 14 and 16 are also interposed between the first and second holding members 10 and 12 and are fastened together with the first and second holding members 10 and 12 by the bolt 18. The reinforcing members 14 and 16 are members having predetermined rigidity or more. The reinforcing members 14 and 16 are fastened together with respective members at the fastening portion of the first holding member 10 and the first lighting unit 3, the fastening portion of the first holding member 10 and the second lighting unit 4, and the fastening portion of the first holding member 10 and the second holding member 12. Accordingly, the reinforcing members 14 and 16 suppress deformation of the respective members in the fastening portions and reinforce the respective members.

Figure 7:
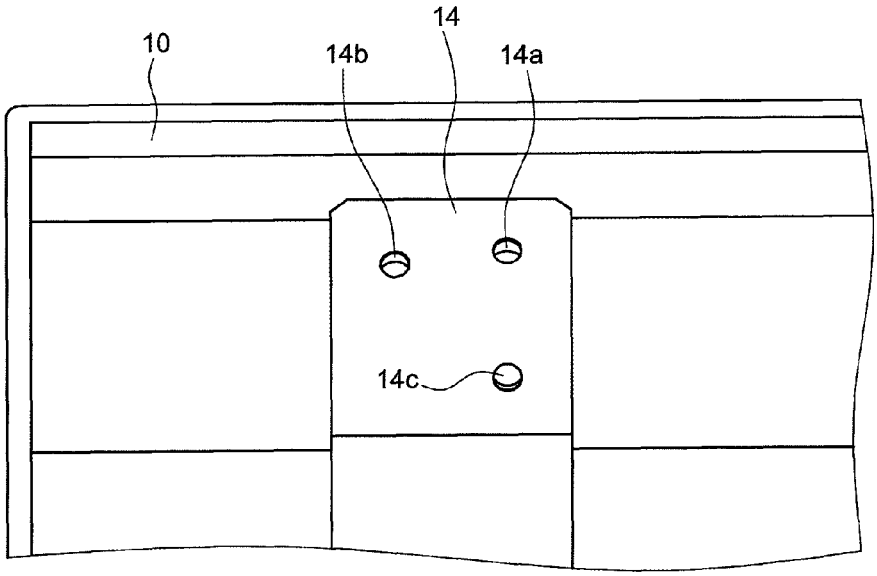
FIG. 7 is an explanatory view illustrating part of a first holding member and a reinforcing member at an enlarged scale.

As illustrated in FIG. 7, in the first holding member 10 and the reinforcing member 14 of the holding unit 2, a plurality of bolt holes in which the bolt 20 can be inserted are formed in the fastening portion of the first holding member 10 and the first lighting unit 3 and the fastening portion of the first holding member 10 and the second lighting unit 4. In FIG. 7, three bolt holes 14*a*, 14*b*, and 14*c* are formed in the reinforcing member 14. The same holes are formed in the first holding member 10, and the respective bolt holes 14*a*, 14*b*, and 14*c* communicate with the holes of the first holding member 10. The bolt holes 14*a*, 14*b*, and 14*c* are formed at different positions (positions on the cross-sections of the concave surfaces 10*a* and 10*b*) on the arc of the first holding member 10. Since the holding unit 2 has the bolt holes 14*a*, 14*b*, and 14*c* formed at a plurality of different positions on the arc, it is possible to change the insertion direction (angle) of the bolt 20 by changing the bolt holes 14*a*, 14*b*, and 14*c* in which the bolt 20 is inserted. Accordingly, it is possible to change the direction (angle) of the first lighting unit 3 (i.e., $\theta_1$) and the direction (angle) of the second lighting unit 4 (i.e., $\theta_2$) with respect to the holding unit 2. Although the reinforcing member 14 has been described with reference to FIG. 7, the reinforcing member 16 has the same configuration. Moreover, bolt holes are formed at positions of the reinforcing member 16 such that the positions (the positions on the cross-section of the concave surfaces 10*a* and 10*b*) on the arc of the first holding member 10 are the same as or correspond to the positions of the bolt holes 14*a*, 14*b*, and 14*c*. Accordingly, even when the first and second lighting units 3 and 4 are fixed to the holding member 10 at different directions, both can be connected at two positions of the position corresponding to the reinforcing member 14 and the position corresponding to the reinforcing member 16.

<Configuration of Lighting Unit>

Hereinafter, the configuration of the first and second lighting units 3 and 4 will be described with reference to FIGS. 8 to 15. The first and second lighting units 3 and 4 have the same basic structure except that the arrangement positions and directions are different. Thus, in the following description, the configuration of the second lighting unit 4 will be described as a representative example.

Figure 8:
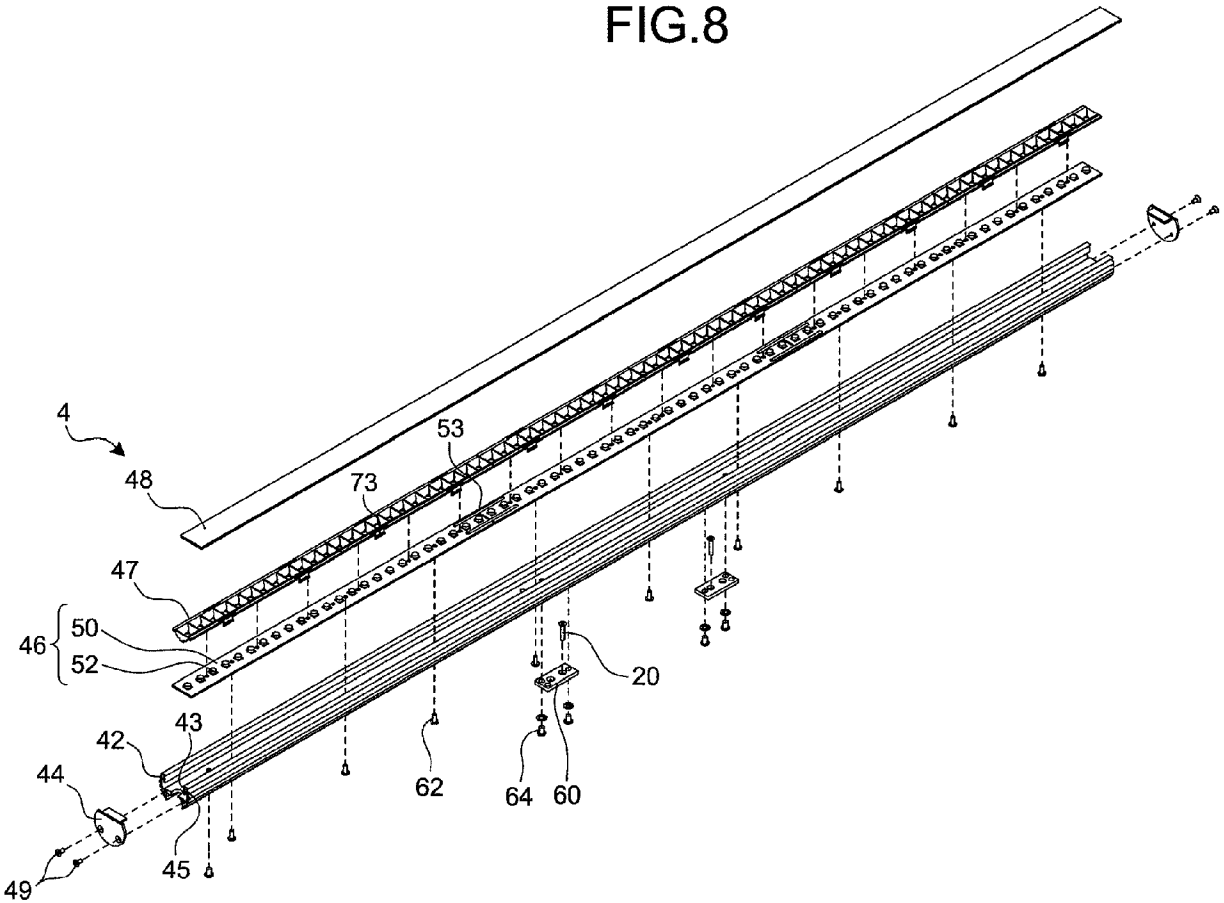
FIG. 8 is an exploded perspective view illustrating an overall configuration of a second lighting unit according to an embodiment.
Figure 9:
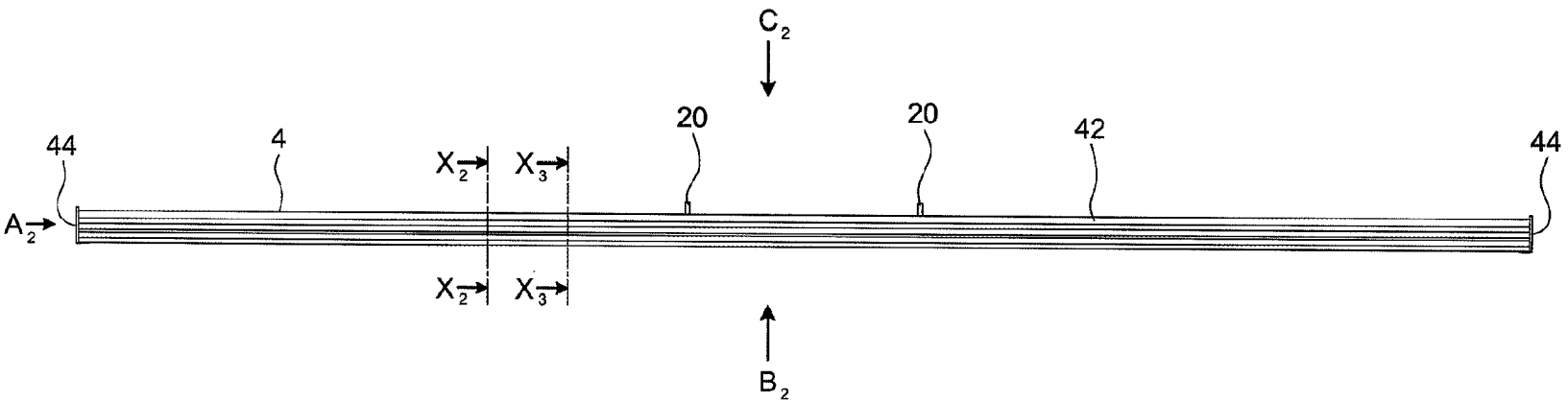
FIG. 9 is an explanatory view of the second lighting unit illustrated in FIG. 8 when seen from one direction.

As illustrated in FIG. 8, the second lighting unit 4 includes a housing 42, a side cover 44, a semiconductor light emitting device 46, a reflector 47, and a light-transmissive substrate 48. The housing 42 and the semiconductor light emitting device 46 of the second lighting unit 4 are fastened by a bolt 62. Moreover, the housing 42 of the second lighting unit 4 and the bolt 20 are fixed by a plate 60 and a bolt 64. The head of the bolt 20 is interposed between the housing 42 and the plate 60. Moreover, the plate 60 is fastened to the housing 42 by the bolt 64.

Figure 10:
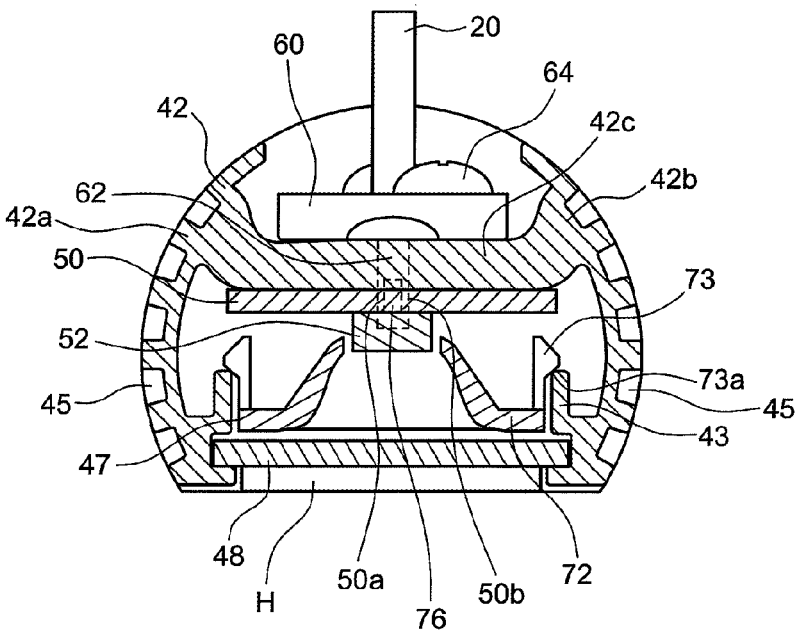
FIG. 10 is a cross-sectional view along line X2-X2, of the second lighting unit illustrated in FIG. 9.
Figure 11:
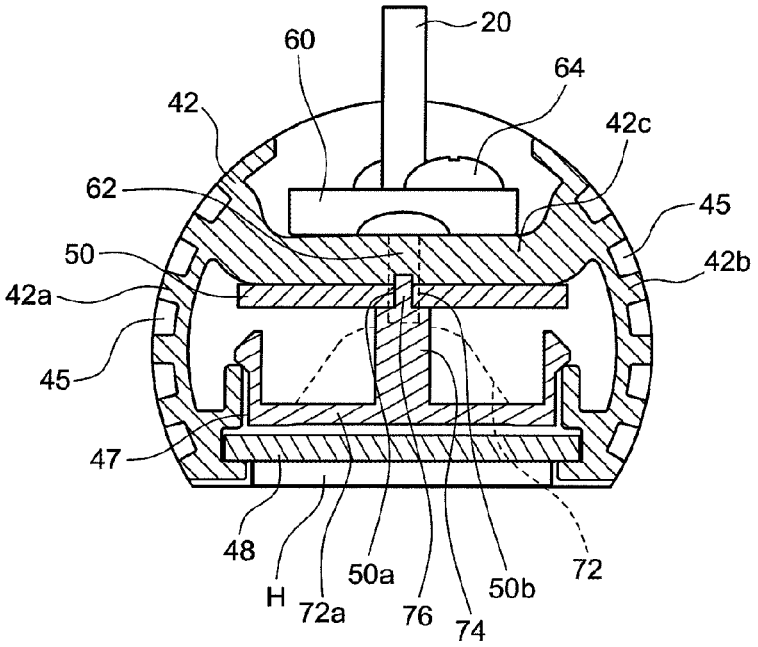
FIG. 11 is a cross-sectional view along line X3-X3, of the second lighting unit illustrated in FIG. 9.
Figure 12:
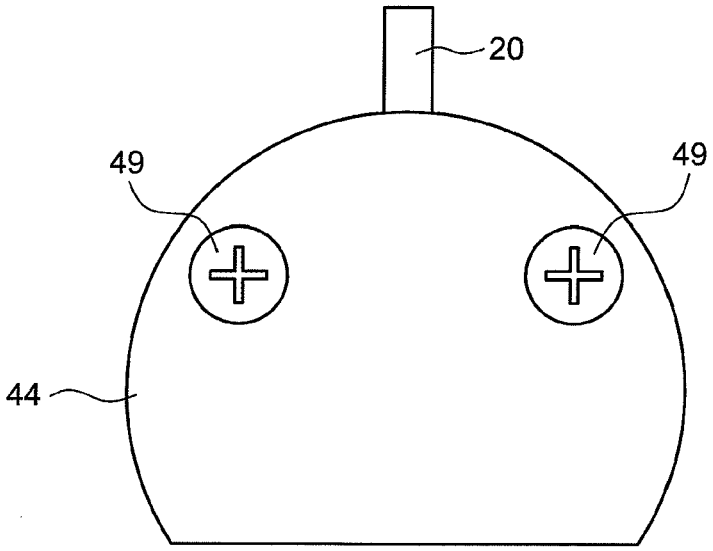
FIG. 12 is an explanatory view of the second lighting unit illustrated in FIG. 9 when seen from a direction indicated by A2.
Figure 13:
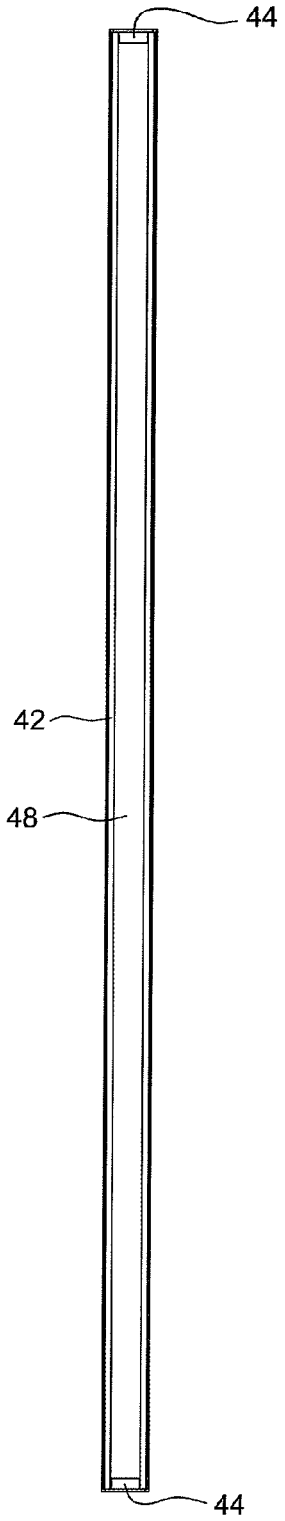
FIG. 13 is an explanatory view of the second lighting unit illustrated in FIG. 9 when seen from a direction indicated by B2.
Figure 14:
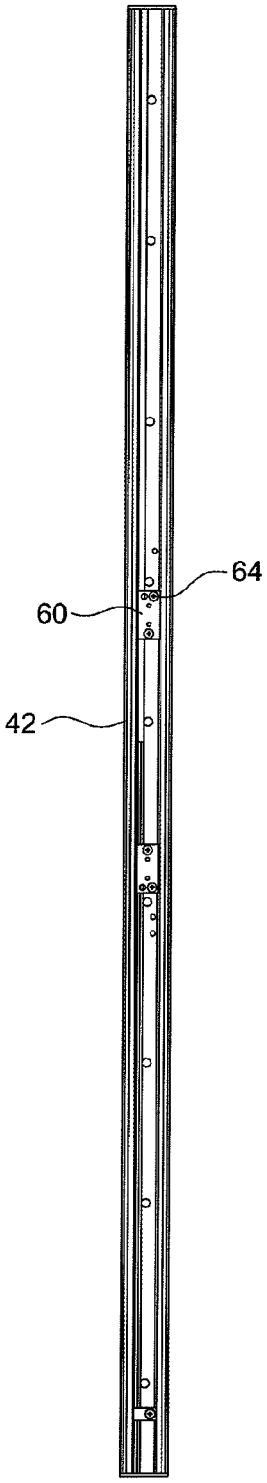
FIG. 14 is an explanatory view of the second lighting unit illustrated in FIG. 9 when seen from a direction indicated by C2.

The housing 42 has a function of holding the semiconductor light emitting device 46 that includes a plurality of semiconductor light emitting elements 52 and a function of radiating heat generated by the plurality of semiconductor light emitting elements 52 of the semiconductor light emitting device 46 to the outside. The housing 42 is formed of metal such as aluminum, copper, or stainless steel, plastics, resins, or the like, for example. In a plan view (vertical cross-sectional view) as illustrated in FIGS. 10 and 11, the housing 42 includes two curved portions (first and second cover portions) 42*a* and 42*b* that are convex to the outside and a plate-shaped portion 42*c* that connects the curved portions 42*a* and 42*b*. In this manner, the housing 42 includes two curved portions 42*a* and 42*b* and the plate-shaped portion 42*c* that connects these curved portions 42*a* and 42*b* and has an H-shaped cross-section. The shape formed by the curved portions 42*a* and 42*b* of the housing 42 is an ellipse or a circle in which openings are formed in two facing directions. One opening of the housing 42 is an opening H, and the other opening of the housing 42 is an opening from which the bolt 20 extends. Moreover, the shape of the cross-section (the cross-section perpendicular to the longitudinal direction of the housing 42) illustrated in FIG. 10, of the curved portions 42*a* and 42*b* is symmetric about the axis of symmetry that is perpendicular to the surface of the plate-shaped portion 42*c*.

The housing 42 has a shape in which a relative positions between the curved portions 42*a* and 42*b* are swollen outward (the distance between them increases) and are then shrunk inward (the distance decreases), between the portions connected to the plate-shaped portion 42*c* and the opening H. That is, the curved portions 42*a* and 42*b* have a curved shape that is convex to the outside. Moreover, a locking portion 43 that protrudes toward the plate-shaped portion 42*c* is formed in the ends of the curved portions 42*a* and 42*b* of the housing 42 closer to the opening H. The locking portion 43 is a portion that protrudes from the inner wall of the curved portion 42*a* or 42*b* toward the center of the opening H. Moreover, a groove in which the end of the light-transmissive substrate 48 is inserted is formed near the ends of the curved portions 42*a* and 42*b* of the housing 42 closer to the opening H.

The housing 42 efficiently radiates heat generated by the semiconductor light emitting device 46 to the outside. Moreover, the housing 42 can maintain satisfactory directivity of the light output to the outside by reducing a change in the inclination angle of the semiconductor light emitting device 46. Heat conductivity of the housing 42 is set in the range of 16 W/m·K to 401 W/m·K, for example.

Moreover, the housing 42 has a concavo-convex shape in which a plurality of recesses (grooves) 45 are formed on the outer periphery of the curved portions 42*a* and 42*b*. Accordingly, it is possible to further improve heat radiation of the housing 42. The recesses (grooves) 45 extend along the extension direction of the housing 42. That is, the recesses (grooves) 45 are formed along the longitudinal direction of the first and second lighting units 3 and 4. Moreover, the outer periphery of the curved portions 42*a* and 42*b* of the housing 42 forms a portion of the convex surface 4*a* described above and faces the concave surface 10*b* of the first holding member 10. Since the plurality of recesses (grooves) 45 are formed on the outer periphery of the curved portions 42*a* and 42*b*, depressions are formed in portions of the convex surface 4*a*. Accordingly, portions of the regions (regions in which the convex surface 4*a* and the concave surface 10*b* are brought into contact with each other when the recesses (grooves) 45 are not formed on the outer surface) in which the convex surface 4*a* and the concave surface 10*b* face do not make contact with each other. That is, portions where the recesses (grooves) 45 are formed do not make contact with the concave surface 10*b*.

The side cover 44 is disposed at both ends in the longitudinal direction of the housing 42. The side cover 44 is a plate-shaped member that blocks the end in the longitudinal direction of the housing 42 and is fixed to the housing 42 by a screw 49. The screw 49 is screwed into a screw hole formed in the connecting portion between the curved portion 42*a* and the plate-shaped portion 42*c* or the connecting portion between the curved portion 42*b* and the plate-shaped portion 42*c*. The side cover 44 is formed so as to block the ends of the recesses (grooves) 45 that are open upward. As a result, since waterdrops adhering to the lighting apparatus are collected in the recesses (grooves) 45, it is possible to suppress waterdrops from dropping from the lighting apparatus to wet the lighting unit. Moreover, since the waterdrops collected in the recesses (grooves) 45 can be vaporized by the heat from the light emitting elements, the lamp fitting is easily cooled by vaporization heat generated when waterdrops vaporize, and an increase in the temperature of the light emitting device can be suppressed.

Figure 15:
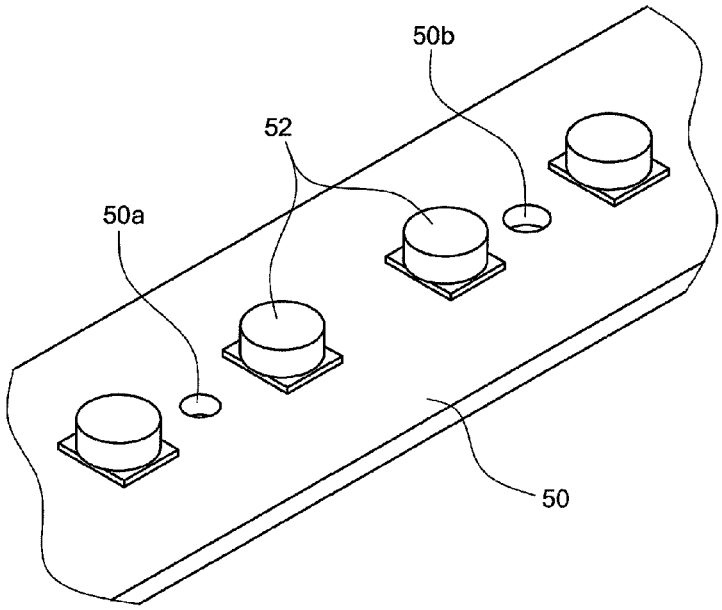
FIG. 15 is a perspective view illustrating an overall configuration of a semiconductor light emitting device illustrated in FIG. 8.

The semiconductor light emitting device 46 includes a plurality of substrates 50, the plurality of semiconductor light emitting elements 52 mounted on the substrates 50, and a connecting member 53 that electrically connects the substrate 50 and the substrate 50. The semiconductor light emitting device 46 is fixed to a surface of the plate-shaped portion 42*c* of the housing 42 closer to the opening H by the bolt 62. The substrate 50 has a cuboid shape. The substrate 50 is connected to another substrate 50 adjacent in the extension direction by the connecting member 53. That is, the semiconductor light emitting device 46 has a configuration in which end surfaces on the short sides of the substrates 50 are connected by the connecting member 53. The semiconductor light emitting device 46 is a long plate member in which a longitudinal dimension of the structure formed by the plurality of connected substrates 50 is approximately the same as the length of the opening H of the housing 42. For example, a resin substrate such as a printed wiring board formed of a resin, a glass substrate, or a metal substrate such as an aluminum substrate is used as the substrate 50. As illustrated in FIGS. 10, 11, and 15, a hole 50*a* in which a projection 76 (described later) of the reflector 47 is inserted and a hole 50*b* to which the bolt 62 is fastened are formed in the substrate 50.

In the present embodiment, the plurality of semiconductor light emitting elements 52 are mounted at an equal interval on the substrate 50. The semiconductor light emitting element 52 is a light source that outputs light. The semiconductor light emitting element 52 will be described later. The interval at which the plurality of semiconductor light emitting elements 52 are arranged is not limited to the equal interval.

Moreover, the semiconductor light emitting device 46 further includes a driver (not illustrated) that is electrically connected to the semiconductor light emitting elements 52 of the semiconductor light emitting device 46. The driver is electrically connected to an external power supply, from which electricity is supplied. The installed position of the driver is not limited to this, and the driver may be formed on the same surface of the substrate 50 as the semiconductor light emitting element 52 as long as the driver is electrically connected to the semiconductor light emitting elements 52 of the semiconductor light emitting device 46.

The reflector 47 is a member that reflects light emitted by the semiconductor light emitting element 52 to the outside, that is, a member that guides light emitted by the semiconductor light emitting element 52 toward the opening H. A shade portion 72 is provided in the reflector 47 in a manner surrounding the side surface of the semiconductor light emitting element 52. The shade portion 72 of the reflector 47 corresponding to one semiconductor light emitting element 52 is connected to another shade portion 72 corresponding to the adjacent semiconductor light emitting element 52. That is, the reflector 47 has a shape that the shade portions 72 are connected in a row along the extension direction of the semiconductor light emitting device 46.

The reflector 47 is configured to reflect light emitted from the semiconductor light emitting element 52 and is formed of a good heat-conductor having excellent heat conductivity such as aluminum, copper, or stainless steel, for example. Alternatively, the reflector 47 may be formed by depositing aluminum to the inner wall of the reflector 47 that is molded by a mold and formed of a polycarbonate resin. The reflectors 47 are disposed in a manner surrounding respective semiconductor light emitting elements 52. The heat conductivity of the reflector 47 is set in the range of 10 W/m·K to 500 W/m·K, for example.

The shade portion 72 of the reflector 47 is formed in a manner swollen as it advances from the semiconductor light emitting element 52 to the opening H (an output port of the reflector 47) of the housing 42. The shade portion 72 of the reflector 47 is a so-called parabolic cylindrical member. Since the region surrounded by the shade portion 72 of the reflector 47 broadens as it advances toward the output port of the shade portion 72 of the reflector 47, it is possible to suppress light emitted from the semiconductor light emitting element 52 from being blocked by the shade portion 72 of the reflector 47 and to broaden an irradiation area of the light emitted by the semiconductor light emitting element 52.

As illustrated in FIGS. 10 and 11, the reflector 47 has a claw portion 73 formed in an end of the shade portion 72 closer to the opening H. The claw portion 73 has a shape that extends toward the substrate 50 (the plate-shaped portion 42*c*) from the end of the shade portion 72 closer to the opening H. An end of the claw portion 73 closer to the substrate 50 extends toward the substrate 50 further than the distal end (the end closer to the substrate 50) of the locking portion 43. The claw portion 73 has a shape that the end (distal end) closer to the substrate 50 protrudes outward (outward in the short-side direction of the opening H, that is, to the direction away from the shade portion 72). A surface 73*a*, closer to the opening H, of the outward protruding portion formed at the distal end of the claw portion 73 faces the distal end of the locking portion 43. Moreover, an outer end of the surface 73*a* of the claw portion 73 protrudes outward further than the inner end of the distal end of the locking portion 43. Accordingly, when the claw portion 73 is caused to move toward the opening H further than a predetermined position, at least a portion of the surface 73*a* is brought in contact with the distal end of the locking portion 43. As illustrated in FIG. 8, a plurality of claw portions 73 have a certain width and is arranged at an equal interval in a reflector 47 in the extension direction of the reflector 47. The claw portion 73 may have a shape that extends in a plurality of shade portions 72. The claw portion 73 may be provided to be integrated with other portions such as the shade portion 72 and may be provided to be separated from other portions such as the shade portion 72. When the claw portion 73 is provided to be separated from other portions, the claw portion 73 may be provided as an elastic member formed of a resin or the like, for example.

A base 74 is formed in a region of the reflector 47 that does not face the semiconductor light emitting element 52 in the extension direction of the reflector 47, and specifically, the base 74 is formed in a portion of a connecting portion 72*a* between the shade portion 72 and the shade portion 72. The base 74 protrudes toward the substrate 50 further than the shade portion 72 and is basically in contact with the substrate 50. Further, a projection 76 that protrudes toward the substrate 50 is formed on the base 74 of the reflector 47. The projection 76 is inserted into the hole 50*a* formed in the substrate 50.

The reflector 47 has a structure that, when the reflector 47 is caused to move toward the opening H, the surface 73*a* of the claw portion 73 is brought into contact with the locking portion 43, and thus, the reflector 47 may not be moved toward the opening H further than the position where the surface 73*a* and the locking portion 43 are brought into contact with each other. In this manner, the movable region of the reflector 47 is restricted by the claw portion 73 and the locking portion 43 so that the reflector 47 is not moved toward the opening H further than a predetermined position. Moreover, the reflector 47 has a structure that, when the reflector 47 is caused to move toward the substrate 50, the base 74 is brought into contact with the substrate 50, and thus, the reflector 47 may not be moved toward the substrate 50 further than the position where the base 74 and the substrate 50 are brought into contact with each other. In this manner, the movable region of the reflector 47 is restricted by the base 74 and the substrate 50 so that the reflector 47 is not moved toward the substrate 50 further than a predetermined position. Further, the reflector 47 has a structure that, when the projection 76 is inserted into the hole 50*a* of the substrate 50, the reflector 47 may not be moved on the surface (a surface parallel to the opening H) of the substrate 50 with respect to the substrate 50. In this manner, a movement of the reflector 47 is restricted by the projection 76 and the hole 50*a* so that the relative positions of the reflector 47 and the substrate 50 are not changed on the surface of the substrate 50.

The light-transmissive substrate 48 is provided on an opening edge of the opening H of the housing 42. When the light-transmissive substrate 48 is provided in the housing 42 in a state where the semiconductor light emitting device 46 is mounted inside (on the surface of the plate-shaped portion 42*c* closer to the opening H) of the housing 42, the semiconductor light emitting device 46 disposed in the housing 42 can be protected from the outside.

The light-transmissive substrate 48 is formed of a material that transmits light emitted from the semiconductor light emitting device 46; e.g., a plate member formed of a light transmitting material such as a resin, a glass, etc. The light-transmissive substrate 48 is held by being inserted in a groove formed at an end of the housing 42. The lighting apparatus 1 can prevent the light-transmissive substrate 48 from falling since the light-transmissive substrate 48 is held by being inserted in the groove of the housing 42.

Since the lighting apparatus 1 has the concave surface 10*a* by using a shape of the first holding member 10 and the convex surface 3*a* by using a shape of the housing 42 of the first lighting unit 3, the facing surfaces of the holding unit 2 and the first lighting unit 3 can be brought into contact with each other. Since the lighting apparatus 1 has the concave surface 10*b* by using a shape of the first holding member 10 and the convex surface 4*a* by using a shape of the housing 42 of the second lighting unit 4, the facing surfaces of the holding unit 2 and the second lighting unit 4 can be brought into contact with each other. Moreover, since the recess (groove) 45 is formed on the housing 42, a portion of the concave surfaces 10*a* and 10*b* is not brought into contact with a portion of the convex surfaces 3*a* and 4*a*. In this manner, since both the contacting portion and the non-contacting portion are formed in the facing region, heat can be transmitted from the housing 42 to the first holding member 10 via contacting portion, and air can flow into the non-contacting portion to thereby cool the housing 42 and the first holding member 10. Accordingly, the first holding member 10 and the housing 42 can be cooled while transmitting heat between the first holding member 10 and the housing 42, and therefore it is possible to suppress an increase in the temperature of only one of the first holding member 10 and the housing 42. Moreover, since the contacting portion can be cooled, it is possible to suppress heat from accumulating in the contacting portion to give an adverse effect on the contacting portion. Accordingly, since the lighting apparatus 1 can be appropriately cooled while distributing heat generated by the semiconductor light emitting element 52 to various parts, it is possible to suppress an adverse effect resulting from the heat generated by the semiconductor light emitting element 52.

Moreover, since the plurality of recesses (grooves) 45 are formed on the outer surfaces of the curved portions 42*a* and 42*b* of the housing 42 to form a concavo-convex surface on the surface of the housing 42, it is possible to enhance heat radiation as described above. Further, since the recesses (grooves) 45 are formed along the extension direction of the housing 42, it is possible to make the first and second lighting units 3 and 4 appear narrower and to make stains on the outer surface less noticeable. Accordingly, it is possible to improve the design of the lighting apparatus 1 and to provide a better look. Further, since the recesses (grooves) 45 are formed along the extension direction of the housing 42, and specifically the long and narrow linear recesses (grooves) 45 are formed on the long and narrow housing 42, it is possible to make the housing 42 appear long and narrow, when visually observed. Furthermore, since the recesses (grooves) 45 are formed, when an operator holds the housing 42, the operator touches only the portion where the recesses (grooves) 45 are not formed, and the contact area can be further decreased. In addition, when the operator holds the housing 42, the operator can have the fingers placed on the concavo-convex shape and thus can suitably hold the housing 42 (the first and second lighting units 3 and 4).

Next, a case where the lighting apparatus 1 is used in a state where the opening H faces the vertically downward direction will be described. When the lighting apparatus 1 is installed at a position that the opening H faces the lower side in the vertical direction than the semiconductor light emitting device 46, dew adhering to the surface of the lighting apparatus 1 is likely to accumulate in the recesses (grooves) 45 due to the gravity and it is possible to suppress waterdrops due to dew from adhering to the light-transmissive substrate 48.

Further, the waterdrops accumulating in the recesses (grooves) 45 are easily vaporized by the heat or the like transmitted from the semiconductor light emitting element 52 to the housing 42. Moreover, the housing 42 is cooled by the vaporization heat when the waterdrops accumulating in the recesses (grooves) 45 vaporize, and the lighting apparatus 1 can be cooled.

Moreover, in the lighting apparatus 1, as in the present embodiment, since the plurality of recesses (grooves) 45 extending in the longitudinal direction of the housing 42 are formed in parallel in the direction perpendicular to the longitudinal direction, it is possible to appropriately supply air to the recesses (grooves) 45 and to suitably cool the various parts. The recesses (grooves) 45 are preferably provided in plural and are preferably arranged at regular intervals. When the plurality of recesses (grooves) 45 are formed, it is possible to increase the surface area of the housing 42 and to increase the area in which air makes contact with the housing 42. Moreover, when the recesses (grooves) 45 are arranged at regular intervals, it is possible to uniformize the cross-section shape of the housing 42 and to suppress heat from accumulating in a portion of the housing 42.

In the lighting apparatus 1, as in the present embodiment, since the shape of the concave surface and the convex surface in the cross-section is an arc-shape, it is possible to suitably transmit the heat of the housing 42 to the first holding member 10. Moreover, when the relative positions of the concave surface and the convex surface are adjusted, it is possible to maintain the contact of both even in a case where the relative positions are changed. Since the above described advantageous effects can be obtained, it is preferable that both the concave surface and the convex surface have an arc shape in the cross-section. However, the shape of the concave surface and the convex surface in the cross-section only has to be curved, that is, only has to have a curved portion at least as a part of the shape, and the shape is not particularly limited.

Moreover, as in the present embodiment, the lighting apparatus 1 can have a structure in which no corner is provided by forming the curved portions 42*a* and 42*b* of the housing 42 so as to have a curved shape that is convex to the outside and a shape that is approximate to a circle or an ellipse. Accordingly, it is possible to suppress the housing 42 brought into contact with other members from damaging the other members. Moreover, the area in which the operator holding the housing 42 touches the housing 42 can be decreased as compared to when the a rectangular shape or the like is formed.

The lighting apparatus 1 can adjust the direction of light emitted from the first and second lighting units 3 and 4 by allowing the relative positions of the first holding member 10 and the housing 42 to be changed by the mechanism of the connecting member. Accordingly, it is possible to change the lighting position of the lighting apparatus 1 and the light intensity distribution as necessary. Moreover, as in the present embodiment, since a plurality of holes are formed in the first holding member 10 of the holding unit 2 and the reinforcing members 14 and 16 and are used as the mechanism for switching the holes in which the bolt 20 is inserted and adjusting the angle, it is possible to change the direction of the light emitted from the first and second lighting units 3 and 4 by only changing the insertion position of the bolt 20. Moreover, since the angle can be determined based on the hole position, the direction of the light emitted from the first and second lighting units 3 and 4 can be set to a predetermined angle based on the position of the bolt 20.

The housing 42 that accommodates the plurality of semiconductor light emitting elements 52 of the first and second lighting units 3 and 4 of the lighting apparatus 1 includes the plate-shaped portion 42*c* that supports, on its surface, the substrate 50 on which the plurality of semiconductor light emitting elements 52 are disposed, the curved portion (first cover portion) 42*a* that is connected to one lateral portion (one end of the cross-section perpendicular to the longitudinal direction illustrated in FIG. 10) of the plate-shaped portion 42*c* and extends in a direction perpendicular to the surface, and the curved portion (second cover portion) 42*b* that is connected to the other lateral portion (the other end of the cross-section perpendicular to the longitudinal direction illustrated in FIG. 10) of the plate-shaped portion 42*c* and is disposed to face the curved portion 42*a*. Moreover, one end (an end on a side where the end forms an inner space in collaboration with the surface of the plate-shaped portion 42*c* on which the substrate 50 is disposed) of the curved portion 42*a* of the housing 42 and one end (an end on a side where the end forms an inner space in collaboration with the surface of the plate-shaped portion 42*c* on which the substrate 50 is disposed) of the curved portion 42*b* of the housing 42 are disposed separately from each other by a predetermined distance. The opening H is between one end of the curved portion 42*a* and one end of the curved portion 42*b*. Moreover, the other end of the curved portion 42*a* of the housing 42 and the other end of the curved portion 42*b* of the housing 42 are disposed separately from each other by a predetermined distance. The opening from which the bolt 20 extends is between the other end of the curved portion 42*a* and the other end of the curved portion 42*b*. Since the housing 42 has an H-shape (a shape approximate to the H-shape) that both ends of the curved portions 42*a* and 42*b* connected to the lateral portions of the plate-shaped portion 42*c* are separated, it is possible to increase the rigidity of the housing 42 and to suitably protect the semiconductor light emitting device 46. Moreover, since the housing 42 has the H-shape (a shape approximate to the H-shape), it is possible to form a space on a side opposite to the side where the semiconductor light emitting device 46 is disposed, and to dispose wires or the like to be connected to the semiconductor light emitting device 46 in that space.

Moreover, as in the present embodiment, the shape of the cross-section of the curved portions 42*a* and 42*b* of the housing 42 of the lighting apparatus 1 in the direction perpendicular to the longitudinal direction of the housing 42 is preferably symmetrical about the axis perpendicular to the surface of the plate-shaped portion 42*c*. Accordingly, it is possible to make it easier to handle the first and second lighting units 3 and 4. Moreover, it is possible to suppress a change in the contact area between the housing 42 and the first holding member 10 when the relative positions of the housing 42 and the first holding member 10 are changed.

Moreover, since the lighting apparatus 1 has a structure that the claw portion 73 is formed on the reflector 47, and the claw portion 73 is brought into contact with the locking portion 43 formed on the housing 42, it is possible to fix the relative positions of the reflector 47 and the locking portion 43 without fixing the reflector 47 to the housing 42. Thus, since the reflector 47 can be maintained at a predetermined position without fixing the same to the housing 42, the reflector 47 can absorb the stress resulting from deformation of the housing 42 or the like, and deformation of the reflector 47 can be suppressed. For example, even when the housing 42 or the like is deformed, the reflector 47 can shift its contact position according to the deformation. In this manner, it is possible to suppress force from being concentrated on a portion of the reflector 47 to deform the reflector 47 and to suppress the occurrence of strain in the reflector 47. Moreover, since the lighting apparatus 1 is provided with the claw portion 73 and the locking portion 43, it is possible to decrease the contact area between the reflector 47 and the housing 42. Further, since the contacting portion is not fixed, it is possible to decrease the effect of heat on other members. Accordingly, it is possible to suppress deformation of the housing 42 due to the heat generated at the reflector 47.

Accordingly, the lighting apparatus 1 can suppress a decrease in the reflectance of the reflector 47 caused by heating or deformation of the reflector 47, output light more stably, and illuminate a predetermined region stably. Accordingly, the lighting apparatus 1 can emit light with desired intensity distribution.

Since the lighting apparatus 1 has a structure that the base 74 is provided on the end of the reflector 47 closer to the substrate 50 and the base 74 is brought into contact with the substrate 50, it is possible to restrict the movement of the reflector 47 toward the substrate 50. Accordingly, the lighting apparatus 1 can restrict the movement in both directions perpendicular to the surface of the substrate 50 using the claw portion 73 and the base 74. Accordingly, the lighting apparatus 1 can restrict the movement of the reflector 47 without attaching the reflector 47 or fixing the same to another member by screwing or the like. Accordingly, it is possible to more suitably suppress deformation of the like of the reflector 47 and to obtain the above described advantageous effects more suitably.

Since the projection 76 is formed on the base 74 of the reflector 47, and the projection 76 is inserted into the hole 50*a* of the substrate 50, the lighting apparatus 1 can restrict the movement of the reflector 47 with respect to the substrate 50 on the surface (the surface parallel to the opening H) of the substrate 50. Accordingly, it is possible to suppress a shift of the relative positions of the substrate 50 and the reflector 47. Since it is possible to suppress a positional shift between the substrate 50 and the reflector 47, an individual difference in the properties of light output from the lighting apparatuses 1 resulting from a relative positional shift during manufacturing can be suppressed.

Since it is possible to support the reflector 47 at a predetermined position without fixing the same to another member and stabilize output light more, the lighting apparatus 1 according to the present embodiment is provided with the claw portion 73, the base 74, and the projection 76 to restrict the position of the reflector 47; however, the embodiment is not limited to this. The lighting apparatus 1 can obtain the above described advantageous effects to some extent at least by restricting the position of the reflector 47 closer to the opening H using the claw portion 73. Moreover, since the lighting apparatus 1 is basically used in a state where the opening H faces the vertically downward direction, that is, at a position that the opening H faces the lower side in the vertical direction than the semiconductor light emitting device 46, the gravitational force acts on the reflector 47 in the direction toward the opening H. Accordingly, by restricting the movement of the reflector 47 toward the opening H, it is possible to restrict the position of the reflector 47.

In the lighting apparatus 1 according to the present embodiment, when the semiconductor light emitting device 46 emits light, a part of the light emitted by the semiconductor light emitting device 46 changes into heat. However, since the reflector 47 and the semiconductor light emitting device 46 are not directly connected, heat of the semiconductor light emitting device 46 is rarely transmitted to the reflector 47 and is radiated to the outside from the outer wall of the housing 42 through the housing 42. As a result, it is possible to suppress the reflector 47 from being thermally deformed and to suppress the position of the reflector 47 from being shifted relative to the semiconductor light emitting element 52 which is the light source of the semiconductor light emitting device 46. As a result, it is possible to output the light emitted from the semiconductor light emitting device 46 more stably and to illuminate a predetermined region stably.

Moreover, in the lighting apparatus 1 according to the present embodiment, the inner wall of the housing 42 surrounding the semiconductor light emitting device 46 and the reflector 47 is curved in a manner swollen toward the outer side of the housing 42. Although the heat generated by the semiconductor light emitting device 46 is transmitted to the housing 42, by swelling the inner wall of the housing 42, it is possible to increase the distance between the semiconductor light emitting element 52 which is the light source of the semiconductor light emitting device 46 and the claw portion 73 of the reflector 47 and to make heat difficult to be transmitted from the housing 42 to the reflector 47. As a result, it is possible to suppress the reflector 47 from being thermally deformed and to efficiently output the light emitted from the semiconductor light emitting device 46 to the outside. Thus, it is possible to stably illuminate a predetermined region.

In the lighting apparatus 1 according to the present embodiment, the convex surface 3*a* on the outer wall of the housing 42 and the concave surface 10*a* of the first holding member 10 have portions that are not brought into contact with each other and portions that are brought into contact with each other at the relative positions where both surfaces face each other. As a result, it is possible to satisfactorily maintain the arrangement position and angle of the housing 42 with respect to the first holding member 10 and to effectively suppress heat from being transmitted from the first holding member 10 to the housing 42.

Although the lighting apparatus 1 according to the above embodiment includes the first and second lighting units 3 and 4 as a lighting unit that outputs light, the number of lighting units is not limited to this. The lighting apparatus 1 only has to include at least one lighting unit, and therefore the lighting apparatus 1 may include three lighting units, for example. Moreover, although the lighting unit of the lighting apparatus 1 preferably has a long shape (a shape approximate to a fluorescent light) that the plurality of semiconductor light emitting elements 52 of the semiconductor light emitting device 46 are arranged in a row as in the above embodiment, the embodiment is not limited to this. The semiconductor light emitting device 46 only has to include at least one semiconductor light emitting element 52, and the semiconductor light emitting elements may be arranged in various ways.

Configuration of Another Embodiment

Figure 16:
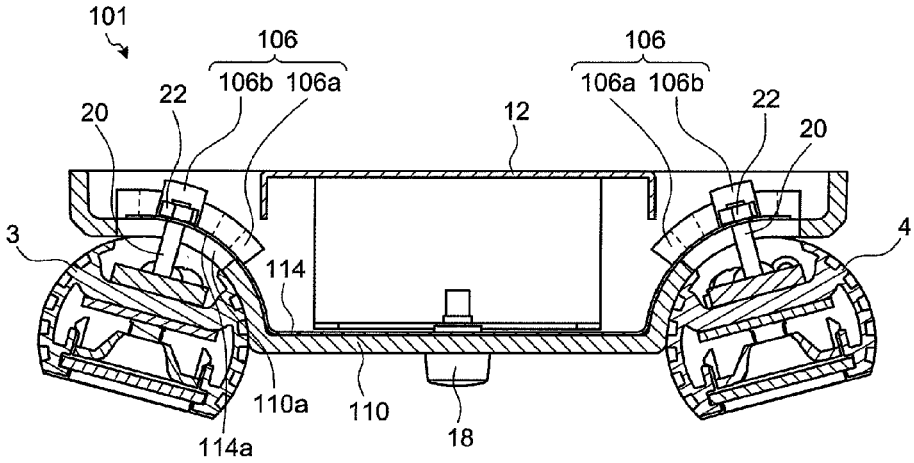
FIG. 16 is a cross-sectional view illustrating another embodiment of the lighting apparatus.

FIG. 16 is a cross-sectional view illustrating another embodiment of the lighting apparatus. In the above embodiment, although the direction of the first and second lighting units 3 and 4 with respect to the holding unit 2 can be adjusted by forming a plurality of holes in which the bolt 20 can be inserted and switching the holes in which the bolt 20 is inserted, the embodiment is not limited to this. For example, a lighting apparatus 101 illustrated in FIG. 16 includes an angle adjustment mechanism 106 that can adjust a relative angle in a state where the holding unit 2 is connected to the first and second lighting units 3 and 4 as a connecting member. The lighting apparatus 101 basically has the same configuration as the lighting apparatus 1 except the connecting member.

The holding unit 2 and the first lighting unit 3 are connected by the same bolt 20 and nut 22 as above. Moreover, the holding unit 2 and the second lighting unit 4 are connected by the same bolt 20 and nut 22 as above. A hole 110*a* which is formed in a first holding member 110 and in which the bolt 20 is inserted has a shape that is long in the direction of adjusting the relative angle. Moreover, similarly, a hole 114*a* which is formed in a reinforcing member 114 and in which the bolt 20 is inserted has a shape that is long in the direction of adjusting the relative angle.

The angle adjustment mechanism 106 includes a stationary part 106*a* and a movable part 106*b*. The stationary part 106*a* is fixed to the first holding member 110 and extends in the direction of adjusting the relative angle. Moreover, the movable part 106*b* is fixed to the bolt 20 and the nut 22 that are connected to the first lighting unit 3. The movable part 106*b* is fixed in a state of being movable in the direction of adjusting the relative angle in respective to the stationary part 106*a*. Moreover, the stationary part 106*a* includes a mechanism that fixes the movable part 106*b* to a position where the movable part 106*b* overlaps with a dashed line in FIG. 16 with predetermined holding power. For example, the mechanism is provided with a gear that, when one tooth of the gear is moved, moving to the next tooth requires predetermined force. Alternatively, the mechanism may be provided with a stopper that can be selectively attached by a predetermined switch so that the movable part 106*b* can move when the stopper is detached, and the movable part 106*b* is fixed at the next overlapping position when the stopper is attached. Thus, it is possible to provide the angle adjustment mechanism capable of changing the relative positions of the holding member and the housing by moving the stationary part 106*a* and the movable part 106*b* relative to each other. Further, it is possible to easily adjust the directions of the first and second lighting units 3 and 4 with respect to the holding unit 2. The angle adjustment mechanism 106 is not limited to adjusting the angle stepwise but may adjust the angle linearly.

Configuration of Semiconductor Light Emitting Element

Figure 17:
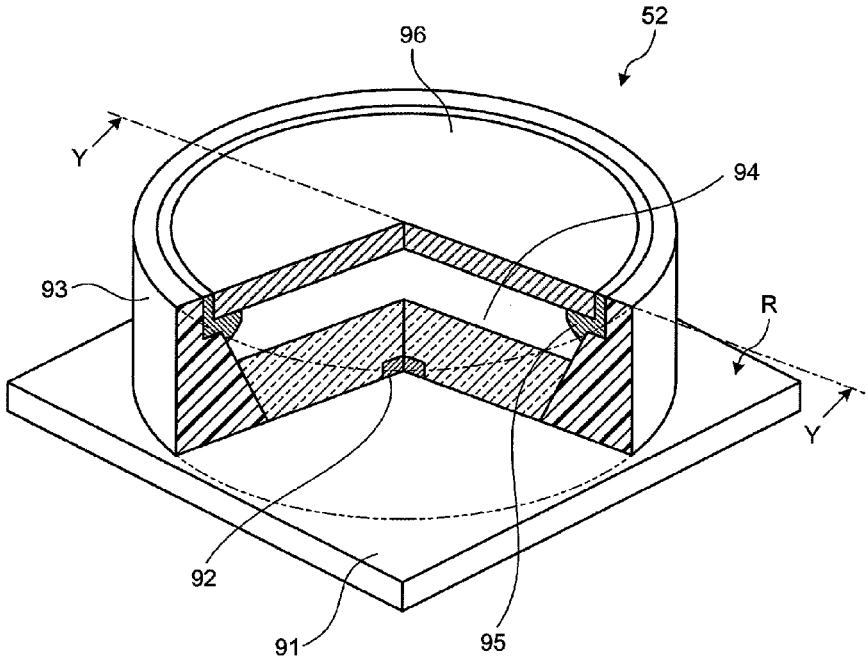
FIG. 17 is a schematic perspective view of a semiconductor light emitting element that constitutes a semiconductor light emitting device.
Figure 18:
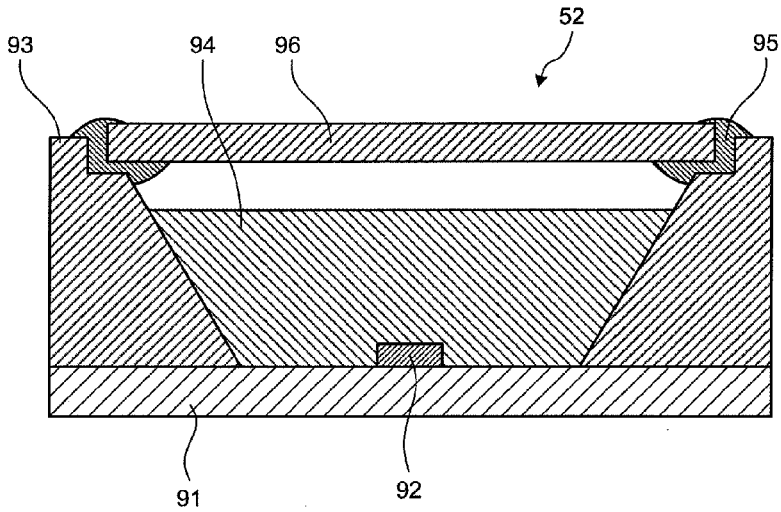
FIG. 18 is a cross-sectional view along line Y-Y, of the semiconductor light emitting element illustrated in FIG. 17.

FIG. 17 is a schematic perspective view of the semiconductor light emitting element that constitutes the semiconductor light emitting device. FIG. 18 is a cross-sectional view along line Y-Y, of the semiconductor light emitting element illustrated in FIG. 17. The semiconductor light emitting element 52 includes a mounting substrate 91, an optical semiconductor element 92 mounted on the mounting substrate 91, a frame 93 that surrounds the optical semiconductor element 92, a sealing resin 94 provided in a region surrounded by the frame 93, and a wavelength converting portion 96 supported by the frame 93 and connected to the frame 93 via an adhesive resin 95 interposed.

The optical semiconductor element 92 is a light emitting diode, for example. When electrons and holes in the pn-junction in the optical semiconductor element 92 recombine, light is emitted from the optical semiconductor element 92 toward the outside. The optical semiconductor element 92 has excellent directivity.

The mounting substrate 91 is mounted on the substrate 50. The substrate 50 and the mounting substrate 91 are bonded so as to be electrically connected by solder or a conductive adhesive. The mounting substrate 91 may be formed of a ceramic material such as alumina, mullite, or glass ceramic, or a composite material obtained by mixing a plurality of materials selected from these materials, for example. Alternatively, a polymer resin in which metal oxide micro-particles are dispersed can be used as the mounting substrate 91.

When the front surface of the mounting substrate 91 is a diffusion surface, the light emitted from the optical semiconductor element 92 is diffused and reflected from the front surface of the mounting substrate 91. Thus, the light emitted from the optical semiconductor element 92 radiates in multiple directions due to diffused reflection, and the light emitted from the optical semiconductor element 92 can be suppressed from being concentrated on a specific position.

A wiring conductor is formed in the mounting substrate 91. The optical semiconductor element 92 is electrically connected to the substrate 50 via the wiring conductor. The wiring conductor is formed of a conductive material such as tungsten, molybdenum, manganese, or copper, for example. The wiring conductor is obtained, for example, by printing a metal paste obtained by adding an organic solvent to tungsten powder or the like on the mounting substrate 91 in a predetermined pattern.

The optical semiconductor element 92 is mounted in a mounting region R on the mounting substrate 91. Specifically, the optical semiconductor element 92 is electrically connected to the wiring conductor formed on the mounting substrate 91 via an adhesive material, such as solder or a conductive adhesive, a bonding wire, or the like, for example.

The optical semiconductor element 92 is manufactured by growing a semiconductor layer on a substrate formed of sapphire, gallium nitride, aluminum nitride, zinc oxide, silicon carbide, silicon, or zirconium diboride using a chemical vapor deposition (CVD) such as a metal organic chemical vapor deposition or a molecular beam epitaxy. The thickness of the optical semiconductor element 92 is in the range of 30 μm to 1000 μm, for example.

The optical semiconductor element 92 includes a first semiconductor layer, a light emitting layer formed on the first semiconductor layer, and a second semiconductor layer formed on the light emitting layer.

The first semiconductor layer, the light emitting layer, and the second semiconductor layer can be formed of III-V-group semiconductors such as gallium phosphides or gallium arsenides, or III-group nitride semiconductors such as gallium nitrides, aluminum nitrides, or indium nitrides, for example. The thickness of the first semiconductor layer is in the range of 1 μm to 5 μm, for example. The thickness of the light emitting layer is in the range of 25 nm to 150 nm, for example. The thickness of the second semiconductor layer is in the range of 50 nm to 600 nm, for example. The optical semiconductor element 92 having such a configuration can emit excitation light in a wavelength range of 370 nm to 420 nm, for example.

The frame 93 is provided on the mounting substrate 91 in a manner surrounding the optical semiconductor element 92. The frame 93 is connected to the mounting substrate 91 via solder or an adhesive, for example. The frame 93 is formed of a porous material such as aluminum oxide, titanium oxide, zirconium oxide, or yttrium oxide, which is also a ceramic material. The frame 93 is formed of a porous material, and a number of micro-holes are formed on the surface of the frame 93.

The frame 93 is formed in a manner surrounding the optical semiconductor element 92 with a space between the optical semiconductor element 92 and the frame 93. Moreover, the frame 93 is formed such that an inclined inner wall thereof broadens outward as it advances from the lower end to the upper end. Thus, the inner wall of the frame 93 functions as a reflecting surface of the excitation light emitted from the optical semiconductor element 92. Moreover, when the inner wall of the frame 93 is a diffusion surface, the light emitted from the optical semiconductor element 92 is diffused and reflected from the inner wall of the frame 93. Thus, the light emitted from the optical semiconductor element 92 can be suppressed from being concentrated on a specific position.

A metal layer formed of tungsten, molybdenum, copper, silver, or the like and a plated metal layer formed of nickel or gold that covers the metal layer may be formed on the inclined inner wall of the frame 93. The plated metal layer has a function of reflecting the light emitted from the optical semiconductor element 92. The inclination angle of the inner wall of the frame 93 is set in the range of 55° to 70°, for example, with respect to the upper surface of the mounting substrate 91.

The sealing resin 94 is filled in the region surround by the frame 93. The sealing resin 94 has a function of sealing the optical semiconductor element 92 and transmitting the light emitted from the optical semiconductor element 92. The sealing resin 94 is filled in the region surrounded by the frame 93 in a state where the optical semiconductor element 92 is accommodated inside the frame 93. A transparent insulating resin such as a silicon resin, an acrylic resin, or an epoxy resin, for example, is used as the sealing resin 94.

The wavelength converting portion 96 is provided in a manner supported by the frame 93 and face the optical semiconductor element 92 with a space therebetween. That is, the wavelength converting portion 96 is provided on the frame 93 with a void interposed between the wavelength converting portion 96 and the sealing resin 94 that seals the optical semiconductor element 92.

The wavelength converting portion 96 is bonded to the frame 93 via the adhesive resin 95. The adhesive resin 95 is deposited to a region that extends from an end of the lower surface of the wavelength converting portion 96 to the side surface of the wavelength converting portion 96 and extends further to an end of the upper surface of the wavelength converting portion 96.

A thermosetting resin such as a polyimide resin, an acrylic resin, an epoxy resin, an urethane resin, a cyanate resin, a silicon resin, or a bismaleimide-triazine resin can be used as the adhesive resin 95, for example. Alternatively, a thermoplastic resin such as a polyether ketone resin, a polyethylene terephthalate resin, or a polyphenylene ether resin can be used as the adhesive resin 95, for example.

As the material of the adhesive resin 95, a material having a thermal expansion coefficient that is between the thermal expansion coefficient of the frame 93 and the thermal expansion coefficient of the wavelength converting portion 96 is selected. By selecting such a material as the material of the adhesive resin 95, it is possible to suppress the frame 93 and the wavelength converting portion 96 from being separated due to a difference in the thermal expansion coefficient of both when both are thermally expanded and to satisfactorily secure both.

Since the adhesive resin 95 is deposited up to the end of the lower surface of the wavelength converting portion 96, it is possible to increase the deposition area of the adhesive resin 95 and to strongly connect the frame 93 and the wavelength converting portion 96. As a result, it is possible to improve the connection strength of the frame 93 and the wavelength converting portion 96 and to suppress bending of the wavelength converting portion 96. Thus, it is possible to effectively suppress a change in the optical distance between the optical semiconductor element 92 and the wavelength converting portion 96.

The wavelength converting portion 96 is configured such that the excitation light emitted from the optical semiconductor element 92 enters therein, and phosphors included therein are excited to generate light. The wavelength converting portion 96 is formed of a silicon resin, an acrylic resin, or an epoxy resin, for example, and a blue phosphor that generates fluorescence having a wavelength of 430 nm to 490 nm, for example, a green phosphor that generates fluorescence having a wavelength of 500 nm to 560 nm, for example, a yellow phosphor that generates fluorescence having a wavelength of 540 nm to 600 nm, for example, and a red phosphor that generates fluorescence having a wavelength of 590 nm to 700 nm, for example, are included in the resin. The phosphors are included in a manner uniformly distributed in the wavelength converting portion 96. The thickness of the wavelength converting portion 96 is set to 0.5 mm to 3 mm, for example.

Moreover, the thickness of the end of the wavelength converting portion 96 is set to be constant. The thickness of the wavelength converting portion 96 is set to 0.5 mm to 3 mm, for example. The constant thickness includes a thickness error of 0.1 mm or smaller. When the wavelength converting portion 96 has a constant thickness, the amount of light excited by the wavelength converting portion 96 can be adjusted to be uniform, and a luminance unevenness of the wavelength converting portion 96 can be suppressed.

What is claimed is:

1. A lighting apparatus comprising:

a lighting unit including a long-shaped housing that has upper and lower openings and has an outer surface formed as a convex surface when seen in a cross-section perpendicular to a longitudinal direction, and a semiconductor light emitting device disposed inside the long-shaped housing and configured to light toward the lower opening; and a holding unit including a holding member in which at least a portion of a surface is formed as a concave surface corresponding to the convex surface when seen in a cross-section perpendicular to the longitudinal direction of the lighting unit, and a connecting member for connecting the lighting unit to the holding member in the upper opening that faces the concave surface, wherein when seen in the cross-section, the convex surface has, in a region that faces the concave surface, a portion that is brought into contact with the concave surface, and a portion that is not brought into contact with the concave surface wherein the connecting member is configured to change relative positions of the holding member and the long-shaped housing.

2. The lighting apparatus according to claim 1, wherein the long-shaped housing has a plurality of grooves that are formed on the convex surface along the longitudinal direction, and a portion of the convex surface where the groove is formed is the portion that is not brought into contact with the concave surface.

3. The lighting apparatus according to claim 1, wherein the concave surface of the holding member has an arc shape when seen in the cross-section, and the convex surface of the long-shaped housing has an arc shape when seen in the cross-section.

4. The lighting apparatus according to claim 1, wherein the connecting member includes a bolt connected to the lighting unit and a nut for fixing the bolt to the holding member, the holding member has, when seen in the cross-section, a plurality of holes through which the bolt passes, and the connecting member is configured to change the relative positions of the holding member and the long-shaped housing by changing the hole in which the bolt is inserted.

5. The lighting apparatus according to claim 1, wherein the connecting member includes a stationary part fixed to the holding member and a movable part connected to the lighting unit, and is configured to change the relative positions of the holding member and the long-shaped housing by moving the stationary part and the movable part relatively.

* * * * *